US010043644B2

(12) United States Patent
Green

(10) Patent No.: US 10,043,644 B2
(45) Date of Patent: Aug. 7, 2018

(54) DE-CONVOLUTION OF OVERLAPPING ION MOBILITY SPECTROMETER OR SEPARATOR DATA

(71) Applicant: MICROMASS UK LIMITED, Wilmslow (GB)

(72) Inventor: Martin Raymond Green, Bowdon (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/310,714

(22) PCT Filed: May 14, 2015

(86) PCT No.: PCT/GB2015/051429

§ 371 (c)(1),
(2) Date: Feb. 8, 2017

(87) PCT Pub. No.: WO2016/173577

PCT Pub. Date: Nov. 19, 2015

(65) Prior Publication Data

US 2017/0076926 A1 Mar. 16, 2017

(30) Foreign Application Priority Data

May 14, 2014 (EP) ..... 14168321
May 14, 2014 (GB) ..... 1408554.2

(51) Int. Cl.
*H01J 49/00* (2006.01)
*H01J 49/40* (2006.01)

(52) U.S. Cl.
CPC ..... *H01J 49/0027* (2013.01); *H01J 49/004* (2013.01); *H01J 49/40* (2013.01)

(58) Field of Classification Search
CPC ..... H01J 49/00; H01J 49/26; H01J 49/0027; H01J 49/40; H01J 49/004
(Continued)

(56) References Cited

U.S. PATENT DOCUMENTS 6,906,321 B2 6/2005 Yamaguchi
7,361,889 B2 4/2008 Yamaguchi
(Continued)

FOREIGN PATENT DOCUMENTS

JP 2008117546 5/2008

OTHER PUBLICATIONS

Salbo et al., "*Traveling-wave ion mobility mass spectrometry of protein complexes: accurate calibrated collision cross-sections of human insulin oligomers*", Rapid Communications in Mass Spectrometry, vol. 26, pp. 1181-1193, 2012.

*Primary Examiner* — Nicole Ippolito

(57) ABSTRACT

A method of mass spectrometry is disclosed comprising separating first ions according to a first physico-chemical property in a first separator wherein at least some of the first ions undergo a different number of cycles or passes within the separator and separating the first ions which emerge from the first separator according to a second physico-chemical property wherein the second physico-chemical property is correlated with the first physico-chemical property. The method further comprises determining the second physico-chemical property of the first ions and determining, assigning or de-convolving the first physico-chemical property of the first ions based upon the determined second physico-chemical property of the first ions.

21 Claims, 6 Drawing Sheets

(58) Field of Classification Search
USPC ..... 250/281, 282, 283, 286, 287
See application file for complete search history.

(56) References Cited

U.S. PATENT DOCUMENTS

| | | | | |
|---|---|---|---|---|
| 7,388,197 | B2 | 6/2008 | McLean et al. | |
| 8,164,054 | B2 | 4/2012 | Nishiguchi et al. | |
| 8,258,467 | B2 | 9/2012 | Kajihara | |
| 8,263,932 | B2 | 9/2012 | Yamaguchi | |
| 8,410,430 | B2 | 4/2013 | Kenny et al. | |
| 8,492,711 | B2 | 7/2013 | Kinugawa et al. | |
| 8,612,162 | B2 | 12/2013 | Furuhashi et al. | |
| 9,207,206 | B2 | 12/2015 | Makarov | |
| 9,281,172 | B2 | 3/2016 | Bateman et al. | |
| 9,406,493 | B2 | 8/2016 | Verenchikov | |
| 2009/0173877 | A1* | 7/2009 | Bateman | G01N 27/622 250/282 |
| 2010/0059673 | A1* | 3/2010 | Makarov | H01J 49/0031 250/283 |
| 2014/0131567 | A1* | 5/2014 | Makarov | H01J 49/004 250/283 |
| 2015/0008318 | A1* | 1/2015 | Makarov | G01N 27/622 250/283 |

* cited by examiner

DE-CONVOLUTION OF OVERLAPPING ION MOBILITY SPECTROMETER OR SEPARATOR DATA

CROSS-REFERENCE TO RELATED APPLICATION APPLICATIONS

This application represents the U.S. National Phase of International Application No. PCT/GB2015/051429 entitled "De-Convolution of Overlapping Ion Mobility Spectrometer or Separator Data" filed 14 May 2015, which claims priority from and the benefit of United Kingdom patent application No. 1408554.2 filed on 14 May 2014 and European patent application No. 14168321.9 filed on 14 May 2014.

FIELD OF THE INVENTION

The present invention relates generally to mass spectrometry and in particular to methods of mass spectrometry, mass spectrometers, cyclic or fast-pulsing ion mobility spectrometers or separator systems and methods of operating the same.

BACKGROUND

Cyclic or multi-pass Time of Flight ("ToF") mass spectrometers are known. In a cyclic or multi-pass Time of Flight mass spectrometer ions undergo multiple passes along the same flight tube during a fixed time period before exiting the flight tube and being directed to an ion detector. This arrangement extends the total length of a flight path within a compact device and thus improves the maximum mass resolution.

However, a particular problem with cyclic or multi-pass Time of Flight separators is that the resulting mass spectrum comprises ion peaks that are not organised in mass to charge ratio order since faster ions are allowed to overtake slower ions within the device during the multiple passes.

In order to construct a meaningful mass spectrum, the number of passes that each species of ions has taken whilst inside the flight tube needs to be determined either by calculation or by estimation. This is a non-trivial problem.

US 2012/0112060 (Kinugawa) discloses a multi-turn Time of Flight mass spectrometer.

U.S. Pat. No. 8,258,467 (Kajihara) discloses a mass analysing method and mass spectrometer.

U.S. Pat. No. 8,164,054 (Nishiguchi) discloses a mass analysis method and mass analysis system.

US 2011/0231109 (Furuhashi) discloses a mass analysis data processing method and mass spectrometer.

According to various known methods, multiple spectra may be acquired for different time of flight durations i.e. different numbers of passes. The multiple spectra may be compared and together with the knowledge of the mass to charge ratio and the flight time characteristics of the analyser, each detected ion can be assigned a mass to charge ratio value and a mass spectrum can thus be constructed. An example of a method of assigning mass to charge ratio to a multi-pulse Time of Flight spectrometer is described in U.S. Pat. No. 8,410,430 (Micromass).

In fast-pulsing or multiplexed ion mobility separators ("IMS") wherein multiple packets of ions are introduced into an ion mobility spectrometer or separator device during an ion mobility separation run, and in cyclic or closed-loop multi-pass ion mobility spectrometer or separator systems, wherein ions make multiple passes before exiting the device it is possible for ions of higher mobility to overtake ions of lower mobility during the separation period. As a result, a similar problem exists as with multi-pass Time of Flight mass spectrometers.

GB-2499587 (Makarov) discloses coupling a multipass ion mobility spectrometer with a mass analyser.

US 2006/024720 (McLean) discloses a method of determining the ion mobility of ions in an IM-MS spectrometer, in which ions in an ion mobility separator are multiplexed by plural injection pulses. Ion mobility is demodulated using an ion mobility-mass to charge ratio correlation function.

The above described problem is particularly acute with multi-pass ion mobility separators and is further compounded by the fact that ion mobility spectrometers or separators have a relatively low resolution compared to, for example, Time of Flight mass analysers. This increases the likelihood of peaks representing different ion mobilities overlapping.

Moreover, without information regarding the charge state of the ions it is difficult to assign collision cross section ("CCS") values to different ions based only on their measured ion mobility.

It is therefore desired to provide an improved method of mass spectrometry.

SUMMARY

According to an aspect there is provided a method of mass spectrometry comprising:

separating first ions according to a first physico-chemical property in a first separator wherein at least some of the first ions undergo a different number of cycles or passes within the separator;

separating the first ions which emerge from the first separator according to a second physico-chemical property wherein the second physico-chemical property is correlated with the first physico-chemical property;

determining the second physico-chemical property of the first ions; and determining, assigning or de-convolving the first physico-chemical property of the first ions based upon the determined second physico-chemical property of the first ions.

According to another aspect there is provided a method of mass spectrometry comprising:

separating first ions according to a first physico-chemical property in a first separator wherein at least some of the first ions are multiplexed within the first separator;

separating the first ions which emerge from the first separator according to a second physico-chemical property wherein the second physico-chemical property is correlated with the first physico-chemical property;

determining the second physico-chemical property of the first ions; and determining, assigning or de-convolving the first physico-chemical property of the first ions based upon the determined second physico-chemical property of the first ions.

The embodiments described above recognise that by combining an ion mobility separation with a second correlated separation (such as mass spectrometry i.e. time of flight separation according to mass to charge ratio) simplifies the determination or assignment of the ion mobility of overlapping species of ions and allows collision cross section to be assigned with a high degree of confidence.

GB-2499587 (Makarov) does not disclose using the result of the mass analyser to determine the ion mobility of the ions.

US 2006/024720 (McLean) only concerns ions undergoing a single pass through the ion mobility separator and does not address issues arise from ions undergoing multiple cycles or passes within a cyclic ion mobility separator or spectrometer.

The combination of ion mobility separation and time of flight mass spectrometry is particularly advantageous as the speed of mass separation allows multiple mass spectra to be acquired during the elution of a single ion mobility peak.

The relatively high resolution of time of flight mass spectrometry allows the signal from overlapping mobility peaks to be extracted for a specific mass range with high specificity thereby reducing ambiguity in assignment.

The correlation between ion mobility and mass separation is due to a strong correlation between collision cross section and molecular weight. This correlation is strong for many small molecules (i.e. molecular weight<5000) although breaks down for higher mass compounds such as large protein complexes.

The embodiments relate to methods of interpreting or de-convolving overlapping ion mobility peaks using a combination of ion mobility and mass to charge ratio separation.

According to the embodiments a method of correctly assigning ion mobility collision or interaction cross section values to each mass to charge ratio recorded by a time of flight mass spectrometer is disclosed.

The embodiments allow determination of the presence of a specific species with known collision cross section in a targeted analysis.

For many applications involving small molecules, including pesticides analysis, pharmaceuticals analysis, metabolic profiling or metabolic identification, protein digests analysis etc. the process of assigning ion mobility peaks to individual mass to charge ratio values is relatively straight forward. However, large proteins, protein complexes or other heavy molecular weight polymers may give rise to complex spectra where each mass to charge ratio value can produce multiple overlapping mobility peaks. In contrast, smaller molecules tend to produce individual well-defined mobility peaks.

The determination of collision cross section can be used to aid the identification of target ions and reduce the likelihood of false-positive identifications. Isomeric compounds may give rise to two or more mobility peaks for the same mass to charge ratio value but these may still be well characterised for a given mass to charge ratio value.

The embodiments recognise that by combining the results of two separations in which the separation parameters are correlated, it is possible to construct a spectrum from separation data that has been generated even when ions are detected not in order of their physico-chemical properties.

The embodiments solve the problem of assigning ion mobility (and hence collision cross section values) to ions which overlap or catch up or take a varying number of cycles through an ion mobility spectrometer or separator. The ions have different ion mobility path lengths when using a cyclic or closed loop ion mobility spectrometer or separator device and the ions do not elute from the ion mobility spectrometer or separator device in order of ion mobility.

The embodiments use the known correlation between mass to charge ratio and ion mobility for a given charge state to allow assignment of mobility and hence cross section to each eluting species.

The first ions which emerge from the first separator may not emerge from the first separator in order of their first physico-chemical property.

The first separator may comprise a cyclic, multi-pass or closed loop separator.

The first physico-chemical property may comprise ion mobility, differential ion mobility, collision cross section ("CCS") or interaction cross section.

The first separator comprise a cyclic, multi-pass or closed loop ion mobility spectrometer or separator.

The first separator may comprise a plurality of electrodes having one or more apertures, wherein ions are transmitted through the one or more apertures.

The method may further comprise applying one or more transient DC voltages or potentials to the plurality of electrodes in order to urge ions along an ion pathway through the first separator.

The step of separating the first ions according to the first physico-chemical property may comprise causing the first ions to undergo multiple integer cycles or passes around or through the first separator.

The step of separating the first ions according to the first physico-chemical property may comprise causing at least some of the first ions to undergo 1-2, 2-3, 3-4, 4-5, 5-6, 6-7, 7-8, 8-9, 9-10, 10-15, 15-20, 20-25, 25-30, 30-35, 35-40, 40-45, 45-50 or >50 cycles of passes around or through the first separator.

The first ions may have substantially different path lengths around or through the first separator.

The method may further comprise creating a two-dimensional data set.

The second physico-chemical property may comprise mass, mass to charge ratio or time of flight.

The step of separating the first ions which emerge from the first separator according to a second physico-chemical property may comprise separating the first ions in a second separator.

The second separator may comprise a Time of Flight mass analyser.

The method may further comprise separating the first ions which emerge from the first separator according to a third physico-chemical property prior to separating the first ions according to the second physico-chemical property.

The step of separating the first ions which emerge from the first separator according to the third physico-chemical property may comprise separating the first ions according to their ion mobility, differential ion mobility, collision cross section ("CCS"), interaction cross section, mass, mass to charge ratio or time of flight.

The method may further comprise determining, calibrating or correlating the relationship between the first physico-chemical property and the second physico-chemical property.

The step of determining, calibrating or correlating the relationship between the first physico-chemical property and the second physico-chemical property for ions may comprise ionising a calibration sample or mixture and generating calibration ions.

The method may further comprise:

separating the calibration ions according to a first physico-chemical property in the first separator;

separating the calibration ions which emerge from the first separator according to a second physico-chemical property wherein the second physico-chemical property is correlated with the first physico-chemical property;

determining the second physico-chemical property of the calibration ions; and determining, assigning or de-convolving the first physico-chemical property of the calibration ions based upon the determined second physico-chemical property of the calibration ions.

The step of determining, calibrating or correlating the relationship between the first physico-chemical property and the second physico-chemical property may comprise determining, calibrating or correlating the relationship between the first physico-chemical property and the second physico-chemical property for ions having a first charge state and/or for ions having a second different charge state.

The method may further comprise separating the first ions according to the first physico-chemical property in the first separator under two or more different conditions and determining the second physico-chemical property of the first ions.

The step of separating the first ions according to the first physico-chemical property in the first separator under two or more different conditions may comprise: (i) varying the path length of the first separator; (ii) varying a voltage gradient maintained along at least a portion of the length of the first separator; (iii) varying the composition of a background or buffer gas within the first separator; or (iv) varying the transit time of the first ions through the first separator.

The method may further comprise reconstructing an ion mobility spectrum or mass chromatogram of the first ions.

The method may further comprise introducing multiple populations or pulses of ions into the first separator during a single separation period or cycle.

The method may further comprise multiplexing ions within the first separator by introducing multiple populations, packets or pulses of ions into the first separator during a single separation period or cycle.

The step of multiplexing ions within the first separator by introducing multiple populations, packets or pulses of ions into the first separator during a single separation period or cycle may comprise allowing multiple discrete populations, packets or pulses of ions to separate according to the first physico-chemical property within the first separator at substantially the same time.

The method may further comprise determining the charge state of the first ions.

The method of determining the charge state of the first ions may further comprise determining the charge state of the first ions based upon an isotopic distribution, ratio or pattern.

According to another aspect there is provided a mass spectrometer comprising:

a first separator arranged and adapted to separate first ions according to a first physico-chemical property wherein at least some of the first ions undergo a different number of cycles or passes within the separator;

a second separator arranged and adapted to separate the first ions which emerge from the first separator according to a second physico-chemical property wherein the second physico-chemical property is correlated with the first physico-chemical property; and a control device arranged and adapted:

(i) to determine the second physico-chemical property of the first ions; and (ii) to determine, assign or de-convolve the first physico-chemical property of the first ions based upon the determined second physico-chemical property of the first ions.

According to a further aspect there is provided a mass spectrometer comprising:

a first separator arranged and adapted to separate first ions according to a first physico-chemical property wherein at least some of the first ions are multiplexed within the first separator;

a second separator arranged and adapted to separate the first ions which emerge from the first separator according to a second physico-chemical property wherein the second physico-chemical property is correlated with the first physico-chemical property; and a control device arranged and adapted:

(i) to determine the second physico-chemical property of the first ions; and (ii) to determine, assign or de-convolve the first physico-chemical property of the first ions based upon the determined second physico-chemical property of the first ions.

According to an aspect there is provided a method of mass spectrometry comprising:

separating first ions according to a first physico-chemical property in a first separator wherein at least some of the first ions undergo a different number of cycles or passes within the separator and/or are multiplexed within the first separator;

separating the first ions which emerge from the first separator according to a second physico-chemical property wherein the second physico-chemical property is correlated with the first physico-chemical property;

determining the second physico-chemical property of the first ions; and determining, assigning or de-convolving the first physico-chemical property of the first ions based upon the determined second physico-chemical property of the first ions.

According to an aspect there is provided a method of mass spectrometry comprising:

separating one or more populations of ions introduced into a first device by a first physico-chemical property;

separating ions exiting the first device using a second device according to a second physico-chemical property to create a two dimensional data set; and using the information from the second separation device to assign the correct first physico-chemical property to peaks eluting from the first device;

wherein ions of different first physico-chemical properties are allowed to catch up or overtake before exiting the first device.

One or more separate analyses may be performed under different conditions and the results are compared to increase the confidence of assignment and to separate overlapping peaks.

The first device may comprise an ion mobility separator.

The first device may comprise a cyclic ion mobility separator.

The second device may comprise a Time of Flight mass spectrometer.

The second device may comprise an ion mobility separator.

Multiple populations of ions may be introduced into the device during the separation period.

The separation in the second device may be correlated to the separation in the first device.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments will now be described, by way of example only, and with reference to the accompanying drawings in which.

DETAILED DESCRIPTION

According to various embodiments ions may either be introduced into a multi-cyclic or multi-pass separation device so that ions undergo multiple cycles or passes through the separation device or alternatively the ions may be introduced into a fast-pulsing separation device so that ions are multiplexed within the separation device.

According to some embodiments the ions may both undergo multiple cycles or passes through the separation device and may also be multiplexed within the separation device.

A first embodiment relating to a cyclic or multi-pass ion mobility separator or spectrometer will now be described.

Cyclic or Multi-Pass Ion Mobility Separation

A cyclic ion mobility spectrometer or separator system is described in US 2009/014641 (Micromass), the contents of which are incorporated herein by reference.

According to an embodiment, the process of interpreting spectra from a cyclic, closed loop or multi-pass ion mobility spectrometer or separator is simplified by performing multidimensional separations in which a second separation is performed as ions elute from a cyclic, closed loop or multi-pass ion mobility spectrometer or separator.

The second dimension may be mass, mass to charge ratio or time of flight and ions may be mass analysed in a Time of Flight mass analyser as there is a strong correlation between the mass to charge ratio and ion mobility of an ion for a given charge state. The relative high speed of a time of flight analysis enables multiple time of flight separations to be performed during the elution of each ion mobility peak.

Figure 1:
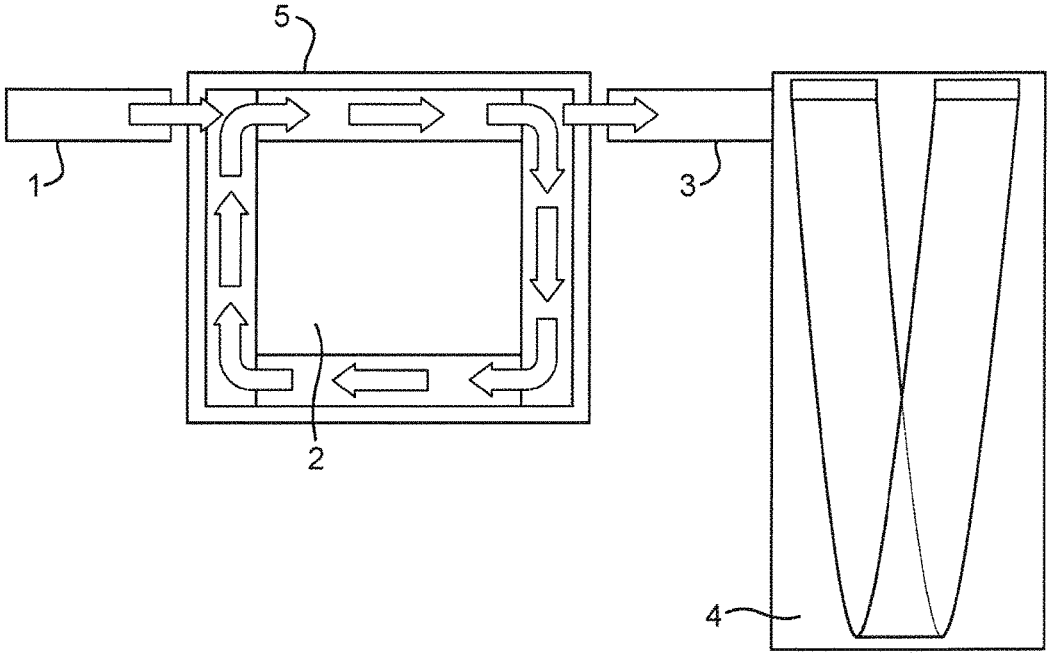
FIG. 1 shows a cyclic ion mobility spectrometer or separator coupled to a Time of Flight mass analyser according to an embodiment.

FIG. 1 shows a schematic of a multi-pass closed-loop travelling wave ion mobility spectrometer or separator 2 coupled to an orthogonal acceleration Time of Flight mass spectrometer 4 according to an embodiment. In operation, ions may be accumulated in an ion trap 1 which may be arranged upstream of the ion mobility spectrometer or separator device 2. Ions may then be pulsed from the ion trap 1 into the ion mobility spectrometer or separator device 2 at a time T0, whereupon the ions are then caused to separate according to their ion mobility over optionally a fixed integer number of cycles around the ion mobility spectrometer or separator device 2. However, as will be detailed below, other embodiments are contemplated wherein the ions do not necessarily make an integer number of cycles around the ion mobility spectrometer or separator 2.

At a subsequent time T1 ions may be allowed to exit the ion mobility spectrometer or separator device 2 and are then passed, e.g. via a transfer cell 3, to the Time of Flight mass analyser 4 or second separator so that ions are then separated according to their mass, mass to charge ratio or time of flight. An ion gate or gate region 5 may be provided which may be closed to allow multi pass operation. The ion gate 5 may be opened after a predetermined time period to allow ions to exit the ion mobility spectrometer or separator 2 and enter the transfer cell 3 after ions have made one or more circuits of the ion mobility spectrometer or separator device 2.

According to a mode of operation, the general relationship between the ion mobility drift time (dt) of an ion and the mobility K of an ion, and between the ion mobility drift time and the mass to charge ratio of an ion for different charge states is first determined by running a calibration mixture through the apparatus. This calibration may be performed for a single pass of the ion mobility spectrometer or separator device 2 although multiple passes may be desirable in some cases.

Figure 2:
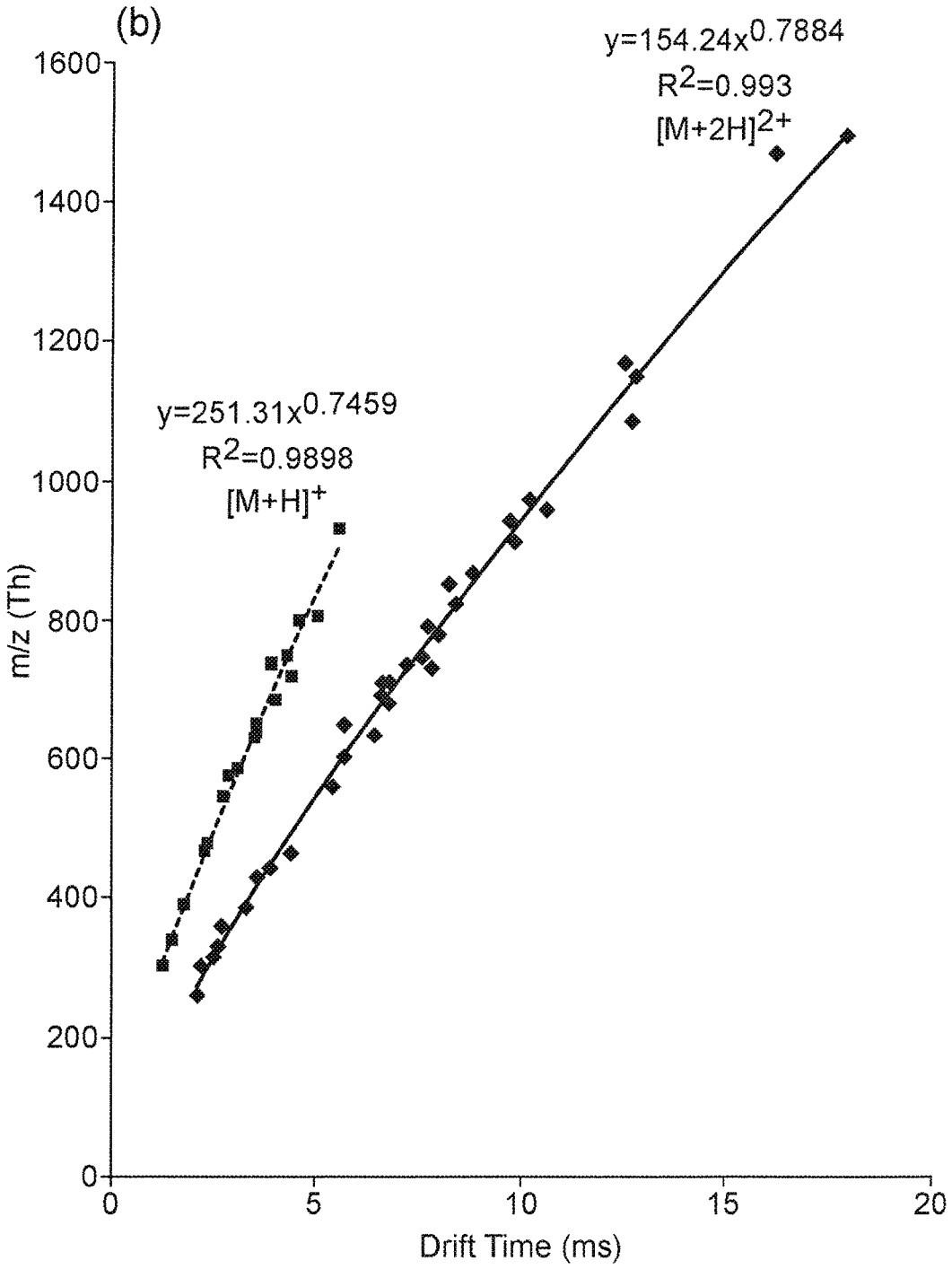
FIG. 2 shows a plot of mass to charge ratio as a function of drift time for singly and doubly charged peptides from a digest of horse albumin.

FIG. 2 shows a plot of mass to charge ratio as a function of ion mobility drift time for singly and doubly charged peptide ions from a digest of horse albumin. A line of best fit representing a trend line for each group of peptide ions is shown. This illustrates a strong correlation between the observed mass to charge ratio and ion mobility drift time and the difference between the trend lines for different charge states. At the same mass to charge ratio value, the ion mobility drift time of an ion is characteristic of its charge state. In reality, different types of ions may fall off these trend lines due to differences in their cross section. However, in most cases these uncertainties are not significant enough to affect the applicability of the method according to embodiments of the present invention.

The plot shown in FIG. 2 provides a means of calibrating a relationship between the mass to charge ratio of an ion for a given charge state and its ion mobility drift time.

For a travelling wave ion mobility spectrometer or separator device the mass to charge ratio of an ion for a given charge state is related to its drift time by an equation of the general form:

$$m/z = A_Q \cdot dt^{B_Q} \tag{1}$$

wherein $A_Q$ and $B_Q$ are calibration constants that may be different for different charge states Q.

It should be noted that this is a simplified expression. In practice, there may be an offset in drift time and/or other additional calibration terms which may or may not be mass and/or mobility dependent, and which may be dependent on the conditions at the entrance of the device during ion injection and/or transit time of ions through one or more downstream devices.

By rearranging Eqn. 1, the drift time of a given ion over a single cycle of the device ($dt_1$) may be estimated using Eqn. 2:

$$dt_1 = \left(\frac{m/z}{A_Q}\right)^{\frac{1}{B_Q}} \tag{2}$$

The mobility of an ion may be calculated from Eqn. 3 for compounds of known cross section:

$$K = \frac{2}{3} \cdot \sqrt{\frac{2\pi}{\mu kT}} \cdot \frac{Q}{n\sigma} \tag{3}$$

wherein n is the drift gas number density, p is the reduced mass of the ion and the drift gas molecule, k is Boltzmann's constant, T is temperature and σ is the collision cross section of the ion.

For a travelling wave ion mobility spectrometer or separator device, the mobility K of an ion is related to its drift time by an equation of the general form shown in Eqn. 4:

$$K = C \cdot dt^{-D} \tag{4}$$

wherein C and D are calibration constants.

It should again be noted that Eqn. 4 is a simplified expression.

Figure 3:
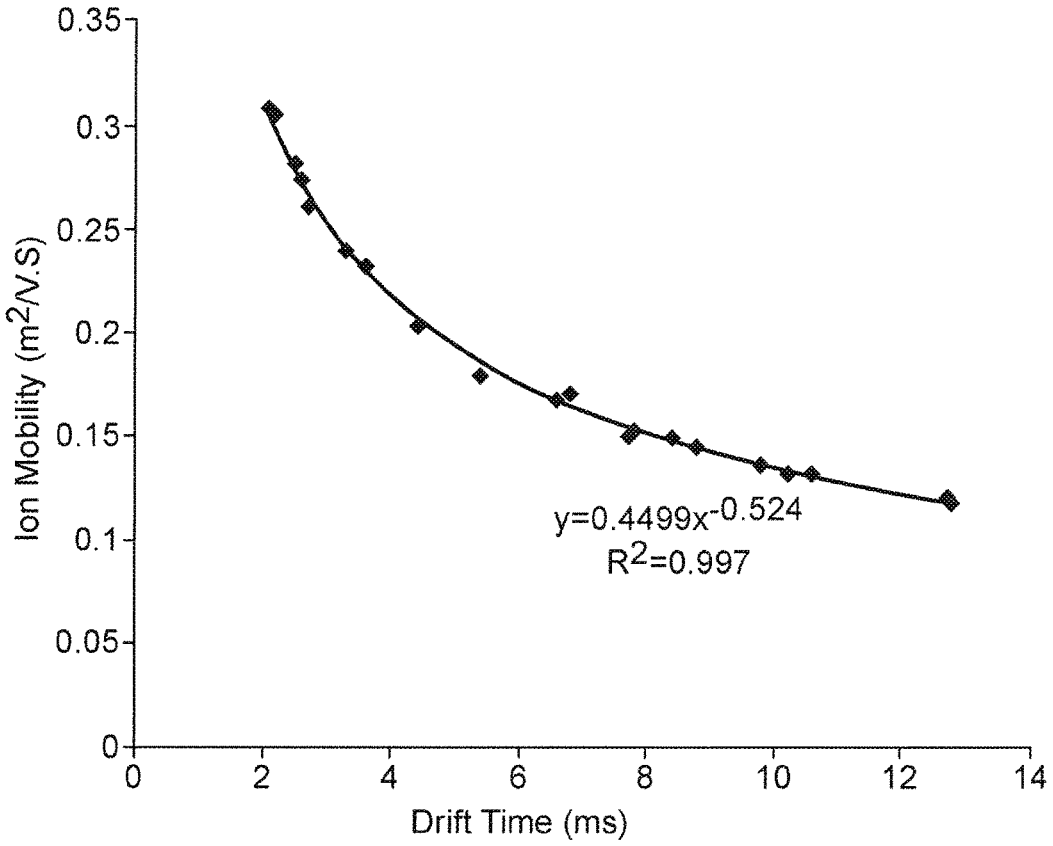
FIG. 3 shows a plot of ion mobility as a function of drift time for singly charged ions of a tryptic digest of horse albumin.

FIG. 3 shows, as an example, a plot of ion mobility as a function of ion mobility drift time for singly charged ions of a tryptic digest of horse albumin.

From the relationships in Eqns. 2 and 4, an expression relating the mobility value K to mass to charge ratio may be derived:

$$K = C \cdot \frac{m/z}{A_Q}^{-\left(\frac{D}{B_Q}\right)} \tag{5}$$

Eqn. 5 gives an estimate of the mobility of an ion based on the mass to charge ratio value and charge state of the ion and is valid if mobility and mass to charge ratio for a given charge state are correlated, e.g. highly correlated.

In a multi-pass experiment, ions may be gated into the ion mobility spectrometer or separator device 2 at a time T0 and the ions may be caused to traverse the ion mobility spectrometer or separator device 2 multiple times.

In the simplest implementation, all ions will pass around the ion mobility spectrometer or separator device 2 for an integer number of times before exiting the ion mobility spectrometer or separator device 2. For an ion of a given mobility, the observed drift time will be n×the drift time for a single pass of the ion mobility spectrometer or separator device 2, wherein n is the number of times the ion travels around the ion mobility spectrometer or separator device 2.

Figure 4A:
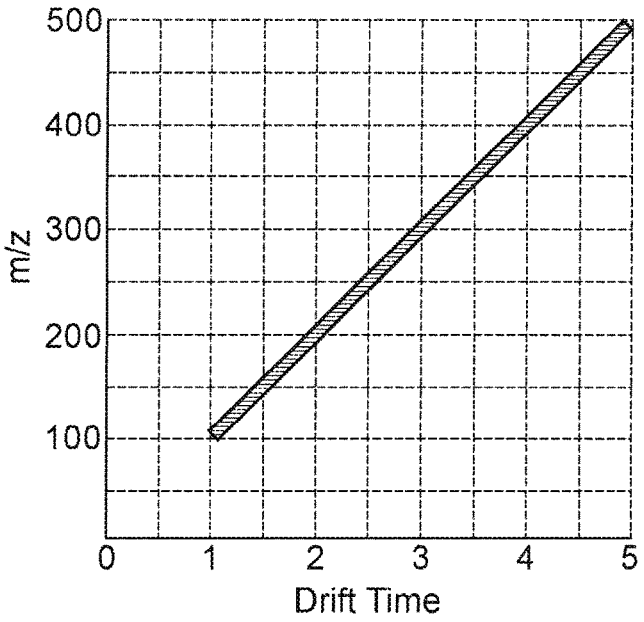
FIG. 4A shows a schematic plot of mass to charge ratio as a function of drift time for singly charged ions after each ion has completed one cycle and FIG. 4B shows a schematic plot of mass to charge ratio as a function of drift time for the same singly charged ions as in FIG. 4A after ions are allowed to exit the ion mobility separator after 4 ms.
Figure 4B:
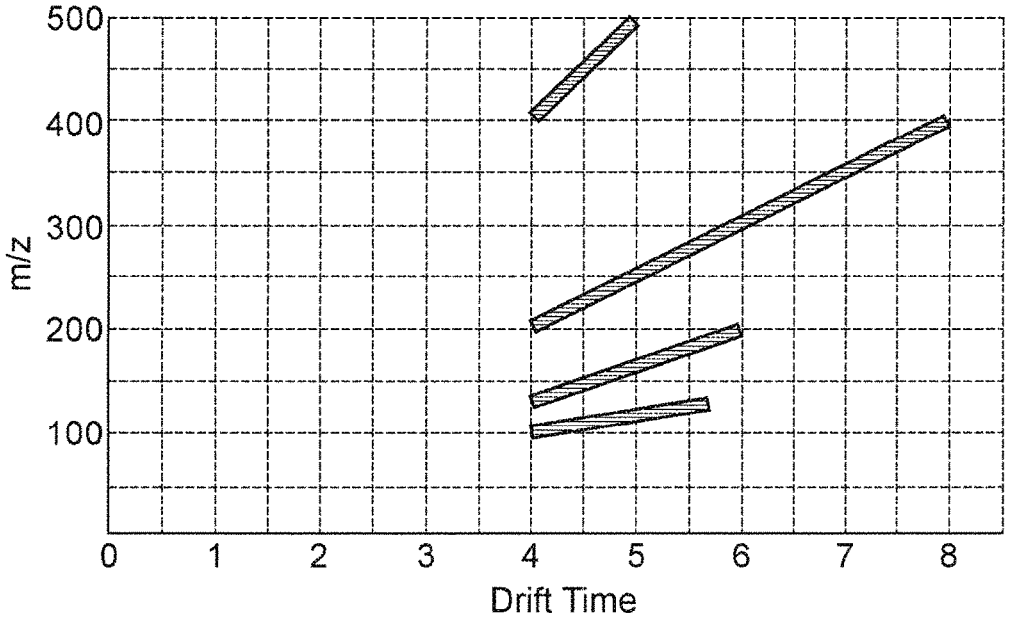

FIGS. 4A and 4B show simplified examples, for the purpose of illustration, of plots of mass to charge ratio as a function of ion mobility drift time (dt) for a plurality of ions that are subjected to a multi-pass ion mobility spectrometer or separator experiment according to an embodiment.

FIG. 4A shows a plot of mass to charge ratio as a function of ion mobility drift time for singly charged ions. In this example, the shaded region denotes the expected mass to charge ratio value for ions that have taken a particular drift time to make a single pass. In this example, ions are gated into the cyclic ion mobility spectrometer or separator device 2 and the ions are allowed to exit after the ions have completed one cycle of the device. Thus, the shaded region illustrates the correlation between mass to charge ratio and ion mobility drift time, and the width of the shaded region illustrates the uncertainty due to variations in ion mobility for different types of compounds at each mass to charge ratio value.

In this example, a simple linear correlation between mass to charge ratio and ion drift time is used for illustrative purpose. As can be seen, the shortest ion mobility drift time is 1 ms for ions having a mass to charge ratio of 100 and the longest ion mobility drift time is 5 ms for ions having a mass to charge ratio of 500.

In the example shown in FIG. 4B, ions are pulsed into the ion mobility spectrometer or separator device 2 and the exit 5 of the device 2 is opened after 4 ms so that ions may exit the ion mobility spectrometer or separator 2.

Ions which take longer than 4 ms to complete one full cycle (i.e. ions having a mass to charge ratio greater than 400) elute after one full cycle and are detected at drift times identical to those shown in FIG. 4A.

However, in this example, ions having mass to charge ratios in the range 200-400 would have passed the ion gate 5 before it opens at 4 ms and must therefore complete a second cycle before the ions reach the exit of the ion mobility spectrometer or separator device 2. Thus, each of these ions would have traversed a path length twice as long as that compared to ions having a mass to charge ratio greater than 400.

Similarly, ions having mass to charge ratios in the range 133-200 will traverse three full cycles around the cyclic ion mobility spectrometer or separator device 2 before exiting. In a similar manner, ions having mass to charge ratios in the range 100-133 will traverse four full cycles around the ion mobility spectrometer or separator device 2 before exiting.

In the present example, ions having mass to charge ratios of 400, 200, 133 and 100 all elute at the same time.

It can be seen that, for those ions that elute simultaneously at the same observed ion mobility drift time, their mass to charge ratio values will differ and the difference in mass to charge ratios can be resolved from each other even at modest mass resolutions. Thus, only modestly low mass resolution is required to construct a mass mobility spectrum with no interferences (overlapping).

In an embodiment, a mass mobility peak is reconstructed for each species of ions using the mass spectral data and the drift time observed.

Several possible values of the mobility, $K'_n$, for each ion using different value for n are calculated using Eqn. 6 below, wherein n represents the number of cycles the ion has traversed around the ion mobility spectrometer or separator device 2 and is an integer ≥1. Eqn. 6 is derived from the initial calibration in Eqn. 4:

$$K'_n = C \cdot \left(\frac{dt}{n}\right)^{-D} \tag{6}$$

The most likely value or values of $K'_n$ are determined for each ion by comparing the possible values of $K'_n$ with the values of K calculated using Eqn. 5 based on the mass spectral data. The charge state Q may be derived from isotope patterns in the mass spectral data.

Eqn. 5 gives an approximate value of K for an ion with a specific charge state and mass to charge ratio value. This value of K is determined based on the correlation between an ion's mass to charge ratio and mobility for a given charge state and is therefore only an approximate measure of K. However, the value is sufficiently accurate for the purpose of determining the likely value of n in Eqn. 6, which can then be used to determine more accurate measurements of the mobility K.

In the example, use is made of the strong correlation between the mass to charge ratio of an ion and the drift time of an ion for a given charge state and the fact that all ions must travel around the device an integer number of times before detection.

Once the mobility K of the ion is determined, the collision cross section may be calculated from Eqn. 3.

In some embodiments, the calculation of ion mobility K from Eqn. 5 may also include an uncertainty band or error band. This uncertainty may be application dependent as it depends on the strength of the correlation between mass to charge ratio and mobility.

For example, if peptides alone appear in the spectrum the uncertainty may be relatively low. Similarly if only lipids are analysed the uncertainty may also be low. In these examples, the correlation between mass to charge ratio and drift time is high.

On the other hand, if a mixture of peptides and lipids and/or other compounds is analysed, the uncertainty may be higher due to the different cross sections of these ions at similar mass to charge ratio values.

In some embodiments, one or more species of ion of interest may be selected based for example on target mass to charge ratio prior to the start of the experiment with known values of drift time.

In these embodiments, the value of K can be known to a high accuracy from the initial calibration. The error in the determination of n (the number of times a species has passed around the ion mobility spectrometer or separator cell) can therefore be very low, and may reflect the precision to which drift time had been measured.

Other information may also be included and used in determining the most likely value of K'.

For example, the way the width of a mobility peak evolves over time. As ions are passing around the device multiple times, a packet of ions with the same mobility value can diffuse spatially, thus leading to a broadening of a mass mobility peak measured at that mobility value.

The average peak width for ions of a specific mass to charge ratio value and charge state may be measured during the initial calibration, and be used to predict the width of mobility peaks expected for ions of a specific mobility which have traveled around the device more than once. This can give an approximate drift time for a given mass to charge ratio and charge state, which can be used to estimate the number of cycles, n, and hence aid in determination of the mobility of the ion.

In addition, the width of an ion mobility peak for a given mass to charge ratio value is narrower for multiply charged ions compared to singly charged ions. This information may be used to reduce ambiguities in the assignment of charge state.

In targeted analysis, the mobility peak shape, skew or kurtosis may be known, which may be used to aid identification of a particular species of ions.

Thus, by reconstructing the extracted mass mobilograms, it is possible to determine the drift time for a peak of a given mass to charge ratio value with a high degree of specificity.

The specificity is largely determined by the resolution of the mass spectrometer, which usually exceeds that of the ion mobility spectrometer or separator device. The intensity-weighted average drift time (or centroid) may be calculated. The charge state of the ion at this drift time may be determined directly from the isotope pattern.

Although most of the peaks in the mobility spectrum may be assigned with a collision cross section value using the methods described above, there may be ambiguity remain in assigning mobility values to specific peaks. This may be due to the precision of the measurements or other factors.

Ions with the same or similar mass to charge ratio value but different mobility may exit the device at the same time. This situation may, for example, occur when ions have very close (approximately 10%) mobility values. For larger deviations in mobility, the mass to charge ratio values of those ions are expected to have larger differences.

For example, if two ions differ in mobility, and hence velocity, by 10%, the two ions are expected to exit the ion mobility spectrometer or separator device 2 simultaneously if they take 10 and 11 cycles, or 20 and 22 cycles etc., respectively before ejection.

According to an embodiment in order to increase confidence in the assignment of mobility values to mobility peaks and to resolve peaks of coincident elution of ions with different mobility, a second ion mobility separation can be performed under different conditions and the results compared with the first experiment.

Figure 5A:
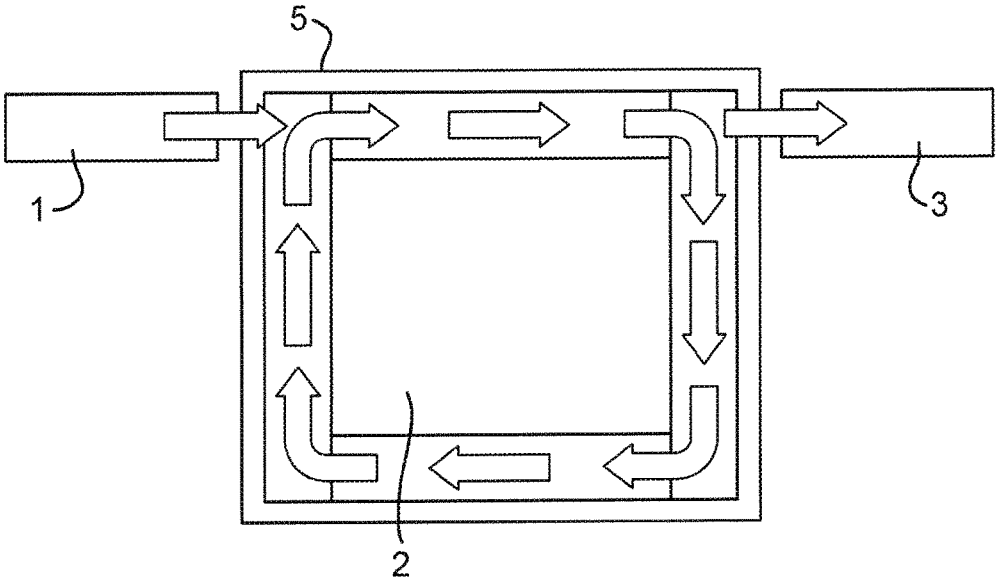
FIG. 5A shows a schematic of an ion mobility spectrometer or separator and FIG. 5B shows a further embodiment wherein the exit position is moved to a different position.
Figure 5B:
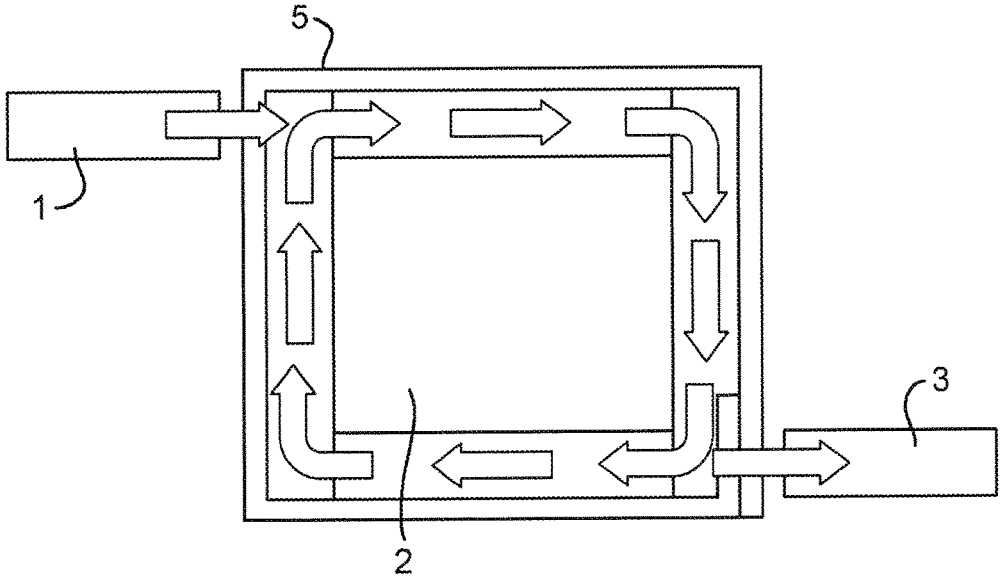

FIGS. 5A and 5B show an example of a ion mobility spectrometer or separation device 2 that may be used to perform the function of the cyclic ion mobility spectrometer or separator device in the methods described above.

FIG. 5B differs from FIG. 5A in that the exit point of the device or transfer cell 3 is at a different position of a cycle such that ions must travel an additional fraction of a cycle before they exit the device as shown in FIG. 5B.

In FIG. 5A, a first separation run for a predetermined time period results in the ions completing an integer number of cycles in the device.

In a second separation run using the arrangement shown in FIG. 5B, the ion gate 5 is opened after the same time period has elapsed. Since the exit position or transfer cell 3 has moved with respect to the entry position each ion must complete an additional fraction of a cycle before exiting. In this final fraction of a cycle, ions of different mobility, which elute simultaneously in the first separation run, are preferably separated in the second separation run. In the present example, for a 10% difference in mobility, the mobility resolving power over the final fraction of a cycle need only be in the order of 10.

Alternatively, the additional fraction of a cycle may be added to the overall path length of the ions by introducing the ions at a different position of the ion mobility spectrometer or separator device or allowing ions to exit at a different point.

Figure 6A:
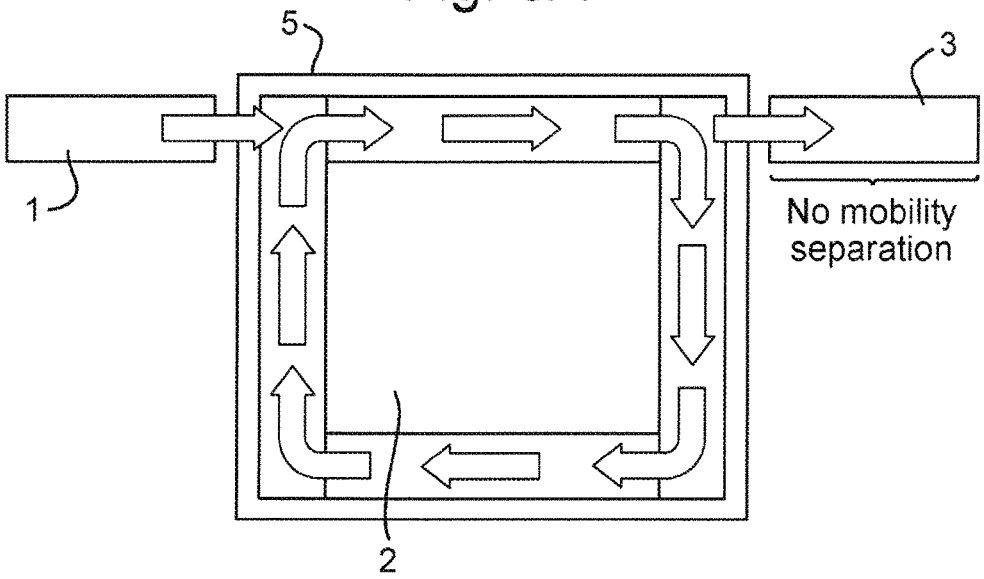
FIG. 6A shows an ion mobility spectrometer or separator with a transfer cell arranged at the exit and FIG. 6B shows an ion mobility spectrometer or separator with the transfer cell acting as an additional separation region.
Figure 6B:
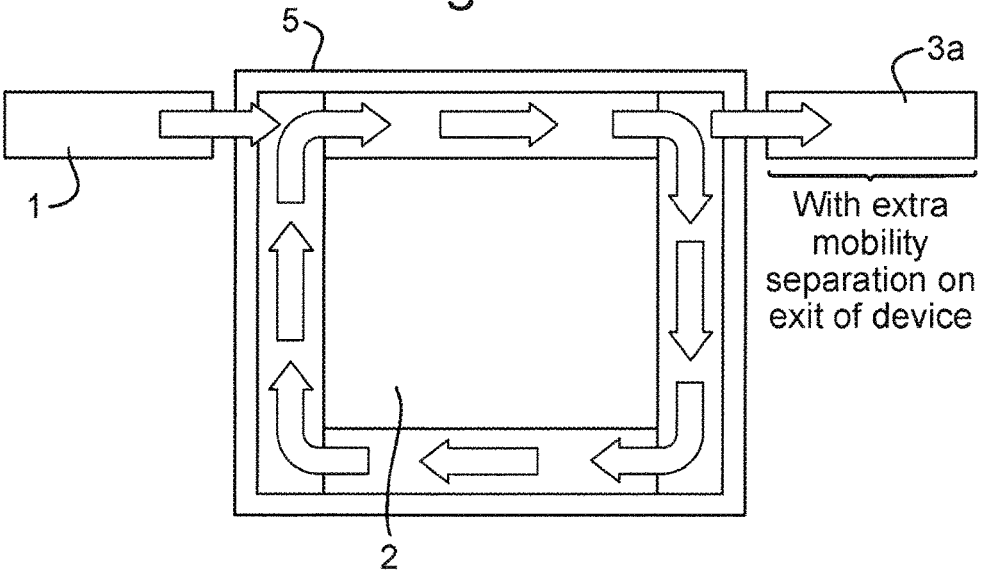

FIGS. 6A and 6B illustrate an alternative method of perturbing the ion mobility separation to collect further information to be analysed.

In a first separation run using the device shown in FIG. 6A, ions are introduced into the ion mobility spectrometer or separation device 2 and allowed to complete multiple cycles in the ion mobility spectrometer or separation device 2 before passing through to a transfer cell 3 (or region) upon leaving the ion mobility spectrometer or separation device 2 at the exit gate. In the arrangement shown in FIG. 6A, the transfer cell 3 is simply a region through which the ions pass from the ion mobility spectrometer or separation device 2 to another device, for example a Time of Flight mass analyser 4, without performing mobility separation on the ions.

In a second separation run using the arrangement shown in FIG. 6B, the transfer cell 3*a* is configured to act as an ion mobility cell to further separate ions according to their ion mobility that exit the ion mobility spectrometer or separation device 2. In this example, ions of the same or similar mass to charge ratio values but different ion mobility which elute simultaneously in the first separation fun, may be resolved by the further mobility separation in the transfer cell 3*a*.

The additional selectable mobility separation length provided by the transfer cell 3 may only have a modest resolving power. The transfer cell 3 may be maintained at the same pressure as the main cyclic ion mobility spectrometer or separator device 2. Switching between a normal (no mobility separation) mode and a mobility separation mode may implemented be by varying the amplitude and/or speed of the ion mobility spectrometer or separator travelling wave or by some bypass mechanism.

In an alternative example, the additional selectable mobility separation region may be provided at the entrance to the main ion mobility spectrometer or separator device.

In an alternative example, the time at which the exit gate 5 of the ion mobility spectrometer or separator device 2 is opened may be varied between experiment runs, thus causing the ions to complete a different number of cycles in the device each time. This arrangement is, however, less preferable as more experiment runs may need to be performed to ensure that ions of different mobility values that elute at the same time are sufficiently separated.

In further alternative examples, the drift time relationship of a travelling wave ion mobility spectrometer or separator may be changed by changing the relative wave amplitude and velocity of the travelling wave. These changes modify the coefficients A and B as given in Eqn. 2. An example is described in Rapid Commun. Mass Spectrom. 2012, 26, 1181-1193, "Traveling-wave ion mobility mass spectrometry of protein complexes: accurate calibrated collision cross-sections of human insulin oligomers", Bush et al.

Other alternatives are possible. Altering the form or the repeat pattern of the wave of a travelling wave ion mobility spectrometer or separator may lead to a change in the mobility drift time relationship. Varying the velocity of the ions in a mobility-dependent way may also allow ions of different mobility values that previously elute simultaneously to be separated.

One or more of the above devices, arrangements and schemes may be used in any combination to improve the confidence in the assignment of mobility values.

For a given mixture of ions to be analysed, more than two experiment/separation runs may be performed if desired.

In each of the examples of mobility separation described above, the relationship amongst drift time, mass to charge ratio, charge state and mobility K may be determined or otherwise calibrated using known ions or ions of known mobility, preferably for a single pass through the device. The ions may be caused to make multiple passes if desired.

In a given experiment run, the possible ion mobility spectrometer or separator separation lengths for different group of ions may be determined or otherwise estimated, hence the most likely value of the mobility K for a given peak (representing a group of ions) may be assigned using the methods described above. By comparing the most likely values of mobility obtained in different experiment runs, the confidence of assigning a mobility value may be improved.

Multiplexed IMS

A second embodiment relating to multiplexed ion mobility spectrometer or separator will now be described.

Although embodiments and examples have been described above using a cyclic ion mobility spectrometer or separator device, the principle of assigning mobility and separating overlapping ion mobility spectrometer or separator peaks may also be applied to any ion mobility spectrometer or separator device, particularly in which ions of different mobility values are allowed to "catch up" while inside the device and therefore elute simultaneously or not in order of mobility.

In the present embodiment, the strong correlation between the collision cross section (mobility) of an ion and the mass (or mass to charge ratio) of the ion is used to enable a determination of ion mobility based on mass to charge ratio and charge state information.

For example, in a fast pulsing ion mobility spectrometer or separator using a linear ion mobility spectrometer or separator device coupled to a downstream mass spectrometer, pulses of ions may be injected into the ion mobility spectrometer or separator device during the separation of a previous pulse of ions. Several populations of ions may therefore be separating simultaneously within the same device. In this case, high mobility ions from a particular pulse may elute simultaneously or before low mobility ions from a previously injected pulse.

This approach has an advantage that fewer ions are stored in an upstream trapping device during an ion mobility spectrometer or separator separation run, thus mitigating space charge problems within the trap and the device.

In this example, an initial calibration of the relationship between drift time and ion mobility is again preferably performed.

At the start of an experiment cycle time (T0), a train of pulses, or packets, of ions may be pulsed into the ion mobility spectrometer or separator device 2 at known times with respect to T0, or at known time intervals. These time intervals may be evenly or unevenly spaced.

Mass chromatograms of each of the eluting ions may be reconstructed. In this example, there may be multiple peaks at one or more mass to charge ratio value which are produced by ions that are pulsed at different times relative to T0. Using the relationship previously determined, each of these peaks may be assigned with an initial start time with respect to T0. Using the relationship between mass to charge ratio value and charge state together with the knowledge of initial start time, ion mobility value may be assigned to each peak and the collision cross section of the ions may be calculated.

If multiple values for each of the peaks are obtained, these values may be combined to improve accuracy.

There may again be situations in which ions of the same or similar mass to charge ratio values have different mobility values, such that if these ions are from different pulses with respect to time T0, they may elute at the same time or sufficiently closely to interfere with measurement of drift time.

The schemes and methods of perturbing an ion mobility spectrometer separation by performing a separate comparative experiment run described above for a cyclic ion mobility spectrometer or separator device may be equally applicable.

For example, the length of the mobility cell or the conditions of separation may be altered between experiment runs.

In alternative examples, parameters of ion mobility separation may be changed such that the velocity of ions changes proportionately for all mobilities. For example, the strength of a DC field may be changed or varied for a linear DC drift cell. This change may allow ions of the same or similar mass to charge ratio but differing mobilities to either overtake or not catch up within the device. This results in separate peaks in the final data which may be assigned with collision cross section provided that the relationship between mobility and drift time is known for ions in each of the conditions used.

In alternative examples, the duty cycle or interval between pulsing of ion packets into the ion mobility spectrometer or separator cell may be changed to allow separation of previously overlapping peaks in a subsequent experiment.

Data from the two or more experiment runs may be combined or compared to improve the confidence in the assignment of collision cross section.

The embodiments described above may be modified and extended to accommodate a fast pulsing or multiplexed cyclic ion mobility spectrometer or separator de-convolution method. In this case, the drift time observed is a result of the number of cycles an ion has taken within the device and the time at which the ions were introduced into the cyclic ion mobility spectrometer or separator device. Using the relationship between drift time and ion mobility and the known time or time intervals at which different packets of ions were introduced into the device, the likely mobility and hence collision cross section may be assigned.

According to an alternative embodiment the ion mobility spectrometer or separator device 2 may be driven by transient DC voltages or travelling waves or a DC voltage gradient.

When using a DC ramp in a cyclic ion mobility spectrometer or separator device, ions that reach the end of the ramp may be driven back to the top of the ramp using transient DC voltages or a travelling wave. An example of this design of cyclic ion mobility spectrometer or separator is described in US 2009/014641 (Micromass) which is incorporated herein by reference.

Different types of peak detection or peak de-convolution algorithms may be applied to determine mass to charge ratio and drift time values including charge state recognition algorithms and multidimensional de-convolution algorithms.

Iterative approaches such as BayesSpray or other probabilistic methods may also be employed to assign mobility values.

Internal or external reference standards of known mass to charge ratio charge and mobility may be introduced to minimize errors in drift time or mass to charge ratio drift (lock drift times).

Although the present invention has been described with reference to preferred embodiments, it will be understood by those skilled in the art that various changes in form and detail may be made without departing from the scope as set forth in the accompanying claims.

The invention claimed is:

1. A method of mass spectrometry comprising:

separating first ions according to a first physico-chemical property in a first separator wherein at least some of said first ions undergo a different number of cycles or passes within said first separator;

separating said first ions which emerge from said first separator according to a second physico-chemical property wherein said second physico-chemical property is correlated with said first physico-chemical property;

determining said second physico-chemical property of said first ions; and determining, assigning or de-convolving said first physico-chemical property of said first ions based upon the determined second physico-chemical property of said first ions.

2. A method of mass spectrometry comprising:

separating first ions according to a first physico-chemical property in a first separator wherein at least some of said first ions are multiplexed within said first separator;

separating said first ions which emerge from said first separator according to a second physico-chemical property wherein said second physico-chemical property is correlated with said first physico-chemical property;

determining said second physico-chemical property of said first ions; and determining, assigning or de-convolving said first physico-chemical property of said first ions based upon the determined second physico-chemical property of said first ions.

3. A method as claimed in claim 1, wherein said first ions which emerge from said first separator do not emerge from said first separator in order of their first physico-chemical property.

4. A method as claimed in claim 1, wherein said first separator comprises a cyclic, multi-pass or closed loop separator.

5. A method as claimed in claim 1, wherein said first physico-chemical property comprises ion mobility, differential ion mobility, collision cross section ("CCS") or interaction cross section.

6. A method as claimed in claim 4, wherein said first separator comprises a plurality of electrodes having one or more apertures, wherein ions are transmitted through said one or more apertures, and wherein the method further comprises applying one or more transient DC voltages or potentials to said plurality of electrodes in order to urge ions along an ion pathway through said first separator.

7. A method as claimed in claim 1, wherein the step of separating said first ions according to said first physico-chemical property comprises causing said first ions to undergo multiple integer cycles or passes around or through said first separator.

8. A method as claimed in claim 1, wherein said first ions have substantially different path lengths around or through said first separator.

9. A method as claimed in claim 1, further comprising creating a two-dimensional data set.

10. A method as claimed in claim 1, wherein said second physico-chemical property comprises mass, mass to charge ratio or time of flight.

11. A method as claimed in claim 1, wherein the step of separating said first ions which emerge from said first separator according to a second physico-chemical property comprises separating said first ions in a second separator, wherein said second separator comprises a Time of Flight mass analyser.

12. A method as claimed in claim 1, further comprising separating said first ions which emerge from said first separator according to a third physico-chemical property prior to separating said first ions according to said second physico-chemical property.

13. A method as claimed in claim 1, further comprising determining, calibrating or correlating the relationship between said first physico-chemical property and said second physico-chemical property, wherein the step of determining, calibrating or correlating the relationship between said first physico-chemical property and said second physico-chemical property for ions comprises ionising a calibration sample or mixture and generating calibration ions.

14. A method as claimed in claim 1, further comprising separating said first ions according to said first physico-chemical property in said first separator under two or more different conditions and determining said second physico-chemical property of said first ions.

15. A method as claimed in claim 14, wherein the step of separating said first ions according to said first physico-chemical property in said first separator under two or more different conditions comprises: (i) varying the path length of said first separator; (ii) varying a voltage gradient maintained along at least a portion of the length of said first separator; (iii) varying the composition of a background or buffer gas within said first separator; or (iv) varying the transit time of said first ions through said first separator.

16. A method as claimed in claim 1, further comprising introducing multiple populations or pulses of ions into said first separator during a single separation period or cycle.

17. A method as claimed in claim 1, further comprising determining the charge state of said first ions.

18. A method as claimed in claim 17, wherein said method of determining the charge state of said first ions further comprises determining the charge state of said first ions based upon an isotopic distribution, ratio or pattern.

19. A mass spectrometer comprising:

a first separator arranged and adapted to separate first ions according to a first physico-chemical property wherein at least some of said first ions undergo a different number of cycles or passes within said first separator;

a second separator arranged and adapted to separate said first ions which emerge from said first separator according to a second physico-chemical property wherein said second physico-chemical property is correlated with said first physico-chemical property; and a control device arranged and adapted:

(i) to determine said second physico-chemical property of said first ions; and (ii) to determine, assign or de-convolve said first physico-chemical property of said first ions based upon the determined second physico-chemical property of said first ions.

20. A mass spectrometer comprising:

a first separator arranged and adapted to separate first ions according to a first physico-chemical property wherein at least some of said first ions are multiplexed within said first separator;

a second separator arranged and adapted to separate said first ions which emerge from said first separator according to a second physico-chemical property wherein said second physico-chemical property is correlated with said first physico-chemical property; and a control device arranged and adapted:

(i) to determine said second physico-chemical property of said first ions; and (ii) to determine, assign or de-convolve said first physico-chemical property of said first ions based upon the determined second physico-chemical property of said first ions.

21. A method as claimed in claim 2, wherein said first separator comprises a cyclic, multi-pass or closed loop separator.

* * * * *